US007381690B1

(12) United States Patent
Ding et al.

(10) Patent No.: US 7,381,690 B1
(45) Date of Patent: Jun. 3, 2008

(54) STABLE AQUEOUS SLURRY SUSPENSIONS

(75) Inventors: Deliang Ding, Allentown, PA (US); Jesse Leaymen, Whitehall, PA (US); Irl E. Ward, Bethlehem, PA (US)

(73) Assignee: PPT Research Inc, Allentown, PA (US)

( * ) Notice: Subject to any disclaimer, the term of this patent is extended or adjusted under 35 U.S.C. 154(b) by 41 days.

(21) Appl. No.: 10/671,399

(22) Filed: Sep. 25, 2003

(51) Int. Cl.
*C10M 103/06* (2006.01)
*C10M 173/02* (2006.01)
*C10M 107/32* (2006.01)

(52) U.S. Cl. ..... 508/137; 508/163; 508/171; 508/172; 508/268; 508/464; 508/545; 508/579; 508/583

(58) Field of Classification Search ..... 508/389, 508/416, 418, 565, 137, 163, 171, 172, 268, 508/464, 545, 579, 583
See application file for complete search history.

(56) References Cited

U.S. PATENT DOCUMENTS 6,348,076 B1 * 2/2002 Canaperi et al. ..... 51/309
6,602,834 B1 * 8/2003 Ward et al. ..... 508/506

* cited by examiner

*Primary Examiner*—Kriellion Sanders
(74) *Attorney, Agent, or Firm*—John Lezdey & Associates

(57) ABSTRACT

An aqueous slurry composition for lapping, saw wire cutting, and finishing operations which contains about 0.1 to 70% by weight of abrasive particles, 0.1 to 20% by weight of suspending particles that have a density of less than or similar to the aqueous or semi-aqueous carrier medium, and the method for creating the suspension.

20 Claims, No Drawings

STABLE AQUEOUS SLURRY SUSPENSIONS

FIELD OF THE INVENTION

The present invention relates to long-term stable aqueous or semi-aqueous slurry suspensions. More particularly there is provided aqueous and semi-aqueous slurries that possess long term stability characteristics i.e., referred to as soft settle properties, which have a use in a number of commercial applications including lapping applications, wire saw cutting, CMP (Chemical Mechanical Polishing/Planarization) metal forming and finishing, and free abrasive grinding.

BACKGROUND OF THE INVENTION

Non-aqueous, semi-aqueous and aqueous suspensions of non-colloidal high density abrasive particles have been previously used in wire saw cutting and lapping of wafers but have been unsuccessful in obtaining a stable slurry. U.S. Pat. No. 5,099,820 issued to Stricot discloses an abrasive slurry of a suspension of silicon carbide particles in water or oil. However, the suspensions are not stable and do not provide uniform lubrication and cutting by the wires. Such compositions require vigorous agitation to maintain a uniform suspension of particles, and the suspensions settles out quickly under stagnant conditions even during work-piece slicing while still under agitation.

Patent application Ser. No. 09/637,263 filed Aug. 10, 2000 to Ward et al, now U.S. Pat. No. 6,602,834 which is herein incorporated by reference, discloses a non-aqueous or semi-aqueous cutting and lubricating composition for use with wire saws that relies upon a surfactant, a polyelectrolyte and pH to provide electrostatic repulsion and particle—particle interference to maintain a stable suspension of abrasive particles.

U.S. Pat. No. 6,054,422 to Ward et al discloses a lubricating composition containing up to 70 weight percent abrasive grit material in a suspension utilizing a mixture of high and low molecular weight polyalkylene glycols and a suspension agent.

In the production of Silicon, SiC, Sapphire, GaAs, optical glass, and other wafers used in a variety of industries (i.e., Microelectronics, Solar Cells, L.E.D.'s, broad band-width devices, optics/lasers, wafer polishing, CMP applications, many others) wafers are cut from larger ingots, bricks, boules, etc. The next step following the initial cut of the wafer, disc, piece, etc., involves the LAPPING of the cut wafer to smooth out the surface, lower the TTV, eliminate damage depth defects and prepare the wafer for final "POLISHING". In general, aqueous carriers are used as the suspension media for the lapping abrasives employed in this step. Lapping abrasives can include, but are not limited to: SiC, Aluminum oxides, $ZrO_2$, Silicas, diamond, etc. Lapping slurries utilize abrasive particles that are in the size range of about 0.5–20 μm. This means that the suspended abrasive particles are typically non-colloidal in size and nature. This does not exclude the use of colloidal lapping abrasive (i.e. abrasive particles of size range from about 0.001–1.0 um), but such particles are not typically used in lapping slurries.

The lapping slurry for wafers, gears, ceramic, etc., is subjected to many shear, grinding, and abrasive forces during the wafer lapping process. During the process of "planetary lapping", the slurry is injected onto the wafer surface, which is held between two large iron plates. Counter rotation of the upper and lower plates holding the wafer compresses the slurry between the upper plate and the wafer surface. The solids within the compressed slurry contact the wafer, and angular momentum, causes the abrasive action to remove surface wafer defects and "etch" away the desired amount of wafer surface material. With all aqueous slurries used today in lapping, such action on the slurry and the design of the lapping equipment propagates particle agglomeration on the wafer, within the reservoir, within the feed piping, within the lapper, on the iron plates, etc. Such particle agglomeration has the added deleterious effect of producing damaging "scratches" on the lapped wafer. Such wafers must then be discarded at great cost.

Aqueous suspension of non-colloidal (i.e. NCOL), high-density abrasive particles has been a severe and debilitating problem for "wafer" manufacturers for several decades. To date, there exists no low viscosity, water-based carrier that will maintain "NCOL" abrasive particle suspension for more than an extremely short time period of a few to several minutes. After that, particles begin to agglomerate and settle out of suspension quickly to the bottom of the container. Such abrasive particle settling in current "aqueous" slurries occurs quickly, even during constant mixing or recirculation. This particle settling is typically manifested by a "hard settled cake" at the bottom of the container. Any attempt to regenerate slurry, which would maintain the original particle size distribution of the virgin abrasive, cannot be accomplished by simple mixing, agitation, shaking or the like. As a result, such slurries are immediately discarded, wasting expensive abrasive, time, manpower, and effort.

In prior art suspensions, temperature, and pH played a factor in the amount of time that a suspension remains homogenous and uniform in extended stagnant storage. Inorganic particles may remain in suspension in aqueous and non-aqueous solvents depending upon the size of the particle, lattice structure and density but in stagnant storage tend to agglomerate and settle out of suspension.

SUMMARY OF THE INVENTION

The present invention relates to the suspension of inorganic or ceramic particles in an aqueous or semi-aqueous carrier which is maintained at ambient as well as elevated temperatures and over a wide pH range including a pH of about 7 to 8.5. According to the invention, particles such as sols, gels, gelatinous, precipitates, etc., are used to suspend abrasive particles due to a particle to particle interference within the aqueous or semi-aqueous carrier environment which is also believed to produce a stable repulsive zeta potential within the environment. The slurry composition can contain about 0.1 to 70% by weight of the abrasive inorganic or ceramic materials and about 0.1 to 20% by weight of generally formed suspending particles which are comprised of other metal oxides, hydroxides, and oxide hydrates that form a suspended precipitate in water within a pH range of about 4 to 12. The aqueous content of the carrier can contain about 5 to 100% by weight of water with an organic solvent making up the difference which is inert and non-reactive with the water medium, the suspending particles which include the abrasive material. The suspending particles have a density similar to or less than the carrier solvent composition.

It is a general object of the invention to provide long-term stable abrasive slurry suspensions which can be used in wire saw applications for cutting slices from ingots, lapping applications, CMP applications, and the like.

It is another object of the invention to provide a long-term stable suspension of abrasive particles in a low toxicity carrier.

It is yet another object of the invention to provide a stable suspension of colloidal or NCOL abrasive or other particles in a neutral or near neutral pH medium.

A further object of the invention is to provide a means for suspending colloidal or NCOL abrasive or other particles in a liquid not depending upon viscosity.

DESCRIPTION OF THE PREFERRED EMBODIMENTS

The present invention provides a means for providing a stable suspension of particles in an aqueous or semi-aqueous medium which have a long stagnant shelf life without agglomeration or abrasive particle hard settling. According to one feature of the invention there is provided lubricating carrier and abrasive slurry compositions which retain a stable zeta potential environment within the carrier for wire saw applications, for example cutting of ingots or boules into wafers or disks for semiconductors or opto-electronic equipment; lapping or polishing slurries, CMP abrasive slurries and the like in which a suspension of particles is maintained at ambient as well as elevated temperature. The abrasive particles are maintained as an aqueous or semi-aqueous slurry by providing about 0.1 to 20 weight percent of suspending particles which provide a particle—particle interference against agglomerates or hard settling and have a particle density less than or similar to the carrier solvent. These suspending particles are metal oxides, hydroxides and oxide hydrates that form a suspended particulate precipitate (i.e. sols, gel slugs, gelatinous precipitate etc.) in water at a pH from about 4 to 12. The abrasive particles comprise the conventional abrasive particles having a particle size of about 3 to 100 μm for saw wire cutting, metal finishing applications and lower for wafer lapping applications being in the range typically of about 0.5 to 20 μm and even lower for CMP application being the range typical of about 50–1000 nm. The preferred suspending particles are those formed in situ such as when a metal salt is formed into the metal hydroxide. In such a case, the density of the in situ prepared precipitated particles is generally lower and the surface area of the particle is greater than commercially available forms of the in situ precipitated form. In addition, there is generally a broader particle size distribution of the in situ form suspended particles.

The abrasive material for use in the above-recited composition may include powders of diamond, silica, tungsten carbide, silicon carbide, boron carbide, silicon nitride, cerium oxide, zirconium oxide, aluminum oxide, or other hard grit "powder" material. One of the most common abrasive materials is silicon carbide. Generally, mean or average particle sizes range from about 0.5–30 microns in wire saw cutting applications, and preferably from 3–20 microns, depending on the international "FEPA or JIS" grade designations of the grit powder. The concentrations of the abrasive material in the suspension medium or carrier for wire saw cutting applications typically may range from about 0.1 to 60 weight percent of abrasive with a particle size range of from about 0.2–50 μm and preferably from about 1–30 μm. For metal finishing or lapping applications, abrasive sizes range from about 6–200 μm and preferably from about 10–100 μm. For wafer C.M.P. (i.e. chemical-mechanical polishing/planarization), abrasive particle sizes may typically range from 10–2000 nm (nanometers) and preferably from about 50–800 nm (nanometers). For ceramics lapping applications, abrasive particle sizes may typically range from about 2–70 μm and preferably from about 6–50 μm.

Solvents which may be used with the water are polar solvents which include alcohols, amides, esters, ethers, ketones, glycols, glycol ethers, alkyl lactones, or sulfoxides. Specifically, examples of polar solvents are dimethyl sulfoxide, dimethylacetamide (DMAC), N-methylpyrrolidone (NMP), (gamma) butyrolactone, diethylene glycol ethyl ether, dipropylene glycol methyl ether, tripropylene glycol monomethyl ether, various polyethylene glycols and poly propylene glycols and the like.

The organic solvents are used in some cases to provide needed viscosity levels to the resulting slurries prepared. Other uses for organic solvents may include a lowering of the slurry/carrier freezing point. The choice of the solvent is relatively immaterial as long as the solvent is inert, non-reactive with water or with the suspended abrasive particles and has low toxicity and is of low odor.

The suspending particles that can be used include, but are not limited to, metal hydroxides, oxide hydrates and oxides other than the abrasive particles that form an aqueous or semi-aqueous suspension (i.e. gel, gelatinous precipitate, sol, colloidal or non-colloidal suspension, solid emulsion, etc.). These suspending particles as an important component of the present invention will not settle out over time. This includes, but is not limited to those compounds, which in situ are within or without the medium converted to the hydroxide form such as a metal sulfate that is converted to the hydroxide form using a metal or non-metal Bronstead base, for example, potassium hydroxide, tetramethyl ammonium hydroxide, sodium hydroxide, tetraethylammonium hydroxide, barium hydroxide, etc. as illustrated by the following example equation:

$$Al_2(SO_4)_3 + 6[(CH_3)_4N]OH \xrightarrow{water} 2Al(OH)_3 + 3[(CH_3)_4N]_2(SO_4)$$

An insoluble fully suspended precipitate or precipitates of aluminum are formed between a pH of about 4 and 12.

Among the suitable metal hydroxides of use in this invention include, but are not limited to $Mg(OH)_2$, manganese hydroxides, aluminum hydroxides, and $Zn(OH)_2$.

Among the metal oxides or oxide hydrates which may be used or formed in situ as suspending particles are $MnO_2$, MgO, ZnO, $SnO_2xH_2O$, $TiO_2$, $Al_2O_3.xH_2O$ and the like. These oxides can also be used to provide the corresponding hydroxides in situ to provide a stable suspended sol, gel, gelatinous or colloidal or non-colloidal suspension for the carrier system.

In the case of $Al(OH)_3$ or other aluminum oxide or hydroxide species, a pH range for use in the carrier is about 4–12. A preferred range is 5.5–9 and the most preferred range is 7–8.5. Within the most preferred range it is believed a stable zeta potential environment exits about the particles enhancing the mutual repulsion of particles within the system.

Excluded as suspending precipitates or particles are those particles having a density significantly greater than that of the carrier solvent, and those that are not naturally precipitous or suspendable. It being understood that there are those metal oxides or hydroxides which have a higher density except when formed or precipitated in situ in the carrier solvent or in another medium which is then added to the carrier systems of this invention.

To quantitatively determine the level of "Soft-Settle" characteristics of an abrasive slurry, i.e. SiC slurry, a precise measurement tool was employed by PPT Research chemists and engineers. The slurry stability of a particular carrier is gauged by its soft settle characteristics (SSR), or, in other words, the resistance of solids suspension to form a hard cake at the bottom of the container, as well as its suspension volume retention (SVR), which measures how well the solid particles remain in suspension. In order to determine if a carrier can create a stable slurry, a slurry containing 15% silicon carbide (SiC) JIS 1000 grade (i.e.; an average particle size between around 13–16 μm) was prepared and stored in 50 mL centrifuge tubes at ambient and 50° C., and the SSR and SVR were measured over an extended period of time. The soft settle was measured using an IMADA Vertical Manual Lever Force Test Stand, Model LV-100. The IMADA measures the force required for a probe with a standard diameter circular pad at the shaft bottom to go through the slurry and reach the bottom of the tube. In order to measure this force, the setup of the IMADA was modified by lengthening the probe shaft so that the probe could reach within 1 mm the coned bottom of the centrifuge tube. The probe was lengthened by attaching a long screw to the probe. The force measured by the IMADA is reported in hundredths of pounds. A low SSR indicates that the abrasive can be easily resuspended, and high value such as ≧1.2 indicates the abrasive has hard settled and cannot be easily resuspended.

The SVR is calculated by measuring the volume the solid occupied within the centrifuge tube (in mL), dividing that volume by the overall volume of the slurry in the centrifuge tube (in mL) and multiplying by 100. The higher the SVR value (closer to 100%), the better the ability of the carrier to hold the abrasive in suspension. The SVR of a slurry generally decreases over time, and is not necessarily indicative of the soft settle characteristics of the slurry. The SSR and SVR were checked daily for a week, followed by once every week.

So that the tool measures "cake-penetration resistance" in a repeatable and precise manner, both standard rod penetration depth and calibration of the tool are checked daily. For a slurry formed within an excellent suspension carrier, "Soft Settle Readings" (i.e. SSR) of penetration resistance are expected to be low; <0.2 lbs. over long storage periods under controlled test conditions i.e., >4 weeks. For slurries formed within poor suspension carriers (like standard PEG-200, 300, or 400, or water for example), SSR's are typically in the region of 1.5–2.0 (i.e. high) within quite short "storage" time periods. In other words, the lower the SSR for a given slurry over time, the more stable, uniform, and better the slurry with respect to everything from performance to storage capability to slurry suspension maintenance to recyclability.

Because the invention relates to aqueous and semi-aqueous media, extended contact of the formulations of this invention with metals such as carbon steel, iron, spring steel, etc., that are typical components of wiresaws, metal finishing lappers, wafer lappers, etc., can result in corrosion or rusting of such metals, it may be advisable to add a corrosion inhibitor.

It is another object of this invention to provide an aqueous or semi-aqueous carrier/slurry system that will not cause corrosion of metals such as iron, carbon steel, etc.

A corrosion inhibitor may be added to the carrier formulations of the present invention to suppress or eliminate metal corrosion. Appropriate inhibitors should not cause foaming, interfere with the formulations ability to provide long-term stable abrasive or solids suspensions, compromise the viscosity, rheology, pH, or uniformity of the carrier formulations and their associated abrasive or solids suspensions.

Suitable corrosion inhibitors which may be added to the aqueous and semi-aqueous carriers of the present invention may include, but are not limited to aliphatic and aromatic carboxylic acids, neutralized carboxylic acids using alkanol amines (i.e. diethanol amine, triethanol amine, etc.), alkyl or aromatic amines or Bronstead bases. Also included may be other known metal corrosion inhibitors in the art such as long chain modified carboxylates commercially under such trade names as DeForest DeCore-APCI-95, DeTrope CA-100. Further examples of known corrosion inhibitors equally suitable for the corrosion prevention or suppression of metals used in CMP processes (i.e. Al/Cu, Cu, Al/Si, Al/Si/Cu, GaAs, LnP, and the like) may include but are not limited to benzoic acid, pyrogallol, gallic acid, ammonium thiosulfate, 8-hydroxy quinoline, catachol, benzotrizole, etc.

Additionally, there are other suitable corrosion inhibitors which function as oxygen absorbers or scavengers which include but are not limited to hydroquinolline, 8-hydroquinoline, nitrites, sulfites, etc.

The selection of the corrosion inhibitors for the purpose of this invention is immaterial as long as the inhibitor meets the above mentioned performance criteria including:

- suppress or eliminate metal corrosion
- does not cause noticeable foaming of the carrier or resulting slurry
- does not compromise or interfere with the ability of the carrier to provide long-term stability of the slurry
- does not deleteriously effect viscosity, pH or rheology of the carrier or resulting abrasive solids suspension
- does not deleteriously effect the uniformity or homogeneity of the carrier suspension or the abrasive solids suspension within the carrier.

The following examples are illustrative of the practice of the method of the present invention. It will be understood, however, that the listed examples are not to be construed in any way limitative of the full scope of the invention since various changes contained herein in light of the guiding principles which have been set forth above. All percentages stated herein are based on weight except where otherwise indicated.

EXAMPLE 1

A 0.5 M aqueous solution of aluminum sulfate hexadecahydrate was added to tap water so that the percent aluminum sulfate in the water was 0.94%. This solution was neutralized with a 0.5 M solution of tetramethyl ammonium hydroxide (TMAH) to a pH of 7.52. The formulation soft settle readings (SSR) and suspension volume retention (SVR) data are listed. The SSR reading of "zero" demonstrates an excellent suspension. The SVR of "20" at the end of 4 weeks is consistent with a well "soft-settled" suspension.

TABLE 1a

| Formulation Data | | | | |
|---|---|---|---|---|
| % Solid $Al_2(SO_4)_3.16H_2O$ | g Tap Water | g 0.4 M $Al_2(SO_4)_3$ | g 0.5 M TMAH | pH |
| 0.94 | 300.00 | 9.75 | 43.24 | 7.52 |

TABLE 1b

| Viscosity, SSR, and SVR Data | | | | | | | | |
|---|---|---|---|---|---|---|---|---|
| | Ambient Soft Settle & SVR | | | | 50° C. Soft Settle & SVR | | | |
| % Solid | Day 1 | | Week 4 | | Day 1 | | Week 4 | |
| $Al_2(SO_4)_3.16H_2O$ | SVR | SSR | SVR | SSR | SVR | SSR | SVR | SSR |
| 0.94 | 29 | 0 | 22 | 0 | 28 | 0 | 20 | 0 |

EXAMPLE 2

Solid aluminum sulfate hexadecahydrate was added to tap water so that the concentration of aluminum sulfate in water was 10.76%. This solution was neutralized with TMAH (25% solution in water) to a pH of 7.69. The formulation, viscosity, SSR and SVR data are listed in the following tables. Again the SSR and SVR readings demonstrate an excellent stable abrasive particle suspension, even after 4 weeks.

TABLE 2a

| Formulation Data | | | | |
|---|---|---|---|---|
| % Solid $Al_2(SO_4)_3.16H_2O$ | g Tap Water | g Solid ($Al_2(SO_4)_3$ | g 25% TMAH | pH |
| 10.76 | 267.73 | 32.24 | 99.25 | 7.69 |

TABLE 2b

| Viscosity, SSR, and SVR | | | | | | | | | | |
|---|---|---|---|---|---|---|---|---|---|---|
| | Viscosity at 25° | | Ambient Soft Settle & SVR | | | | 50° C. Soft Settle & SVR | | | |
| % Solid | (cP) | | Day 1 | | Week 4 | | Day 1 | | Week 4 | |
| $Al_2(SO_4)_3$ | Carrier | Slurry | SVR | SSR | SVR | SSR | SVR | SSR | SVR | SSR |
| 10.76 | 16.0 | 74.0 | 66 | 0 | 42 | 0 | 56 | 0 | 51 | 0 |

EXAMPLE 3

Solid aluminum sulfate hexadecahydrate was added to tap water so that the concentration of aluminum sulfate in water was 15.54%. This solution was neutralized with TMAH (25% solution in water) to a pH of 7.73. The formulation, viscosity, SSR, and SVR data are listed in the following tables. Similar results in terms of slurry stability to those of previous examples were observed. However, in this example, the SVR of 74 after 4 weeks @ 50° C. illustrates an exceptionally stable slurry.

TABLE 3a

| Formulation Data | | | | |
|---|---|---|---|---|
| % Solid $Al_2(SO_4)_3$ | g Tap Water | g Solid ($Al_2(SO_4)_3$ | g 25% TMAH | pH |
| 15.54 | 253.37 | 46.62 | 146.03 | 7.73 |

TABLE 3b

| Viscosity, SSR, and SVR Data | | | | | | | | | | |
|---|---|---|---|---|---|---|---|---|---|---|
| | Viscosity at 25° | | Ambient Soft Settle & SVR | | | | 50° C. Soft Settle & SVR | | | |
| % Solid | (cP) | | Day 1 | | Week 4 | | Day 1 | | Week 4 | |
| $Al_2(SO_4)_3$ | Carrier | Slurry | SVR | SSR | SVR | SSR | SVR | SSR | SVR | SSR |
| 15.54 | 29.4 | 236.5 | 71 | 0 | 58 | 0 | 71 | 0 | 74 | 0 |

EXAMPLE 4

In this example, instead of using tap water as the solvent, a semi-aqueous solvent employing diethylene glycol (DEG), was used. Because aluminum sulfate is not soluble in DEG, a water solution of aluminum sulfate must be prepared before it is added to the DEG. In this case, a 0.4 M solution of aluminum sulfate was prepared and added to the DEG. The pH was then increased with a 25% aqueous solution of TMAH. SSR, SVR and viscosities were measured. The soft settle tubes were prepared with 15% zirconium oxide ($ZrO_2$) instead of SiC. The results are listed in the following tables. The SSR results in Table 4b demonstrate that at ambient temperature, a stable suspension exists after one week when the starting amount of the $Al(SO_4)_3.16H_2O$ exceeds 2.0%. In this case the SSR=0.16, which is indicative of a very "soft-settled" and stable syspension. At 50° C., even an AlS level of 0.49% produces a stable suspension after one week.

TABLE 4a

Formulation Data

| % Solid $Al_2(SO_4)_3$ | % 0.4 M $Al_2(SO_4)_3$ | Weight of DEG* (g) | Weight of 0.4 M $Al_2(SO_4)_3$ (g) | Weight of 25% TMAH (g) | pH |
|---|---|---|---|---|---|
| 0.49 | 2.03 | 386.16 | 7.99 | 5.84 | 8.01 |
| 0.99 | 4.12 | 703.91 | 30.25 | 22.09 | 8.05 |
| 1.50 | 6.28 | 589.22 | 39.45 | 28.83 | 7.80 |
| 2.03 | 8.50 | 566.14 | 52.57 | 38.42 | 7.79 |
| 2.58 | 10.77 | 336.74 | 40.66 | 29.20 | 8.80 |

*DEG = Diethylene Glycol

TABLE 4b

SSR and SVR Data

| | Viscosity at 25° C. (cP) | | Ambient SSR & SVR | | 50° C. SSR & SVR | |
|---|---|---|---|---|---|---|
| % Solid $Al_2(SO_4)_3$ | Carrier | Slurry with 18% $ZrO_2$ | Day 1 SSR | Week 1 SSR | Day 1 SSR | Week 1 SSR |
| 0.49 | 31 | 212 | 0 | 1.16 | 0 | 0.21 |
| 0.99 | 49 | 218 | 0 | 1.24 | 0 | 0 |
| 1.50 | 27 | 217 | 0 | 1.03 | 0 | 0.51 |
| 2.03 | 34 | 353 | 0 | 0.16 | 0 | 0 |
| 2.58 | 32 | 330 | 0 | 0 | 0 | 0 |

EXAMPLE 5

The purpose of the following formulations is to lower the viscosity of the formulation described in Example 4 by diluting the carrier with tap water. The carrier was diluted 25% and 50% with water, keeping the concentration of aluminum sulfate constant between the various dilutions. For this example, 50% dilution is reported in the table below. The soft settle tubes were prepared with 18% zirconium oxide ($ZrO_2$) instead of SiC. The results are listed in the following tables.

TABLE 5a

Formulation Data

| % Solid $Al_2(SO_4)_3$ | Weight of Carrier from Example 4 (g) | Weight of Tap Water (g) | pH |
|---|---|---|---|
| 0.25 | 140 | 140 | 7.77 |
| 0.50 | 140 | 140 | 7.86 |
| 0.75 | 140 | 140 | 7.63 |
| 1.01 | 140 | 140 | 7.71 |
| 1.29 | 140 | 140 | 7.61 |

TABLE 5b

Viscosity, SSR and SVR Data

| | Viscosity at 25° C. (cP) | | Ambient SSR & SVR | | 50° C. SSR & SVR | |
|---|---|---|---|---|---|---|
| % Solid $Al_2(SO_4)_3$ | Carrier | Slurry with 18% $ZrO_2$ | Day 1 SSR | Week 1 SSR | Day 1 SSR | Week 1 SSR |
| 0.25 | 6 | 63 | 0 | 1.3 | 0 | 1.6 |
| 0.50 | 8 | 73 | 0 | 1.5 | 0 | 1.16 |
| 0.75 | 10 | 86 | 0 | 0.76 | 0 | 0.53 |
| 1.01 | 9 | 87 | 0 | 1.1 | 0 | 0.14 |
| 1.29 | 16 | 185 | 0 | 0.73 | 0 | 0 |

The SSR results in Table 5b demonstrate a minimally acceptable reading for "soft-settle" properties of the ambient temperature slurry when the % aluminum sulfate content is ≧0.75%. At 50° C., the SSR indicates a stable "soft-settle" slurry after one week when the % aluminum sukfate content is something >0.50%.

EXAMPLE 6

This example explores whether a metal hydroxide base, such a KOH can be used instead of the non-metal base TMAH used in the other examples. The carrier was prepared by first making a 0.1M solution of aluminum sulfate then adding this solution to deionized water so that the concentration of the 0.1M aluminum sulfate in the solution was 10% by weight. This solution was then neutralized with 0.1M KOH until the pH of the solution was 8.05. The results are listed in the following table. It is apparent by this example that metal hydroxide bases will produce a very stable aqueous abrasive suspension even after 4 weeks of storage.

TABLE 6a

Formulation Data

| % Solid $Al_2(SO_4)_3$ | g Deionized Water | g 0.1 M $Al_2(SO_4)_3$ | g 0.1 M KOH | pH |
|---|---|---|---|---|
| 0.60 | 90.01 | 10.00 | 50.90 | 8.05 |

TABLE 6b

SSR and SVR Data

| Ambient Soft Settle & SVR | | | | 50° C. Soft Settle & SVR | | | |
|---|---|---|---|---|---|---|---|
| Day 1 | | Week 4 | | Day 1 | | Week 4 | |
| SVR | SSR | SVR | SSR | SVR | SSR | SVR | SSR |
| 26 | 0 | 17 | 0 | 21 | 0 | 20 | 0 |

COMPARATIVE EXAMPLE

This example tests if the pH does in fact need to be greater than 4. A 0.1 M aqueous aluminum sulfate hexadecahydrate solution was prepared and added to DI water. The concentration of the 0.1 M aluminum sulfate solution in this carrier was 10% by weight of the $Al(SO_4)_3.16H_2O$. The final pH was about 4. Soft settle tubes were prepared and monitored as explained in the previous examples. The results are listed in the following table. The results of this final listed example demonstrate that at both ambient and 50° C., the SSR values show a "soft-settled" stable slurry suspension even after 4 weeks when the pH is as low as 4.0.

TABLE

SSR and SVR Data

| Ambient Soft Settle & SVR | | | | 50° C. Soft Settle & SVR | | | |
|---|---|---|---|---|---|---|---|
| Day 1 | | Week 4 | | Day 1 | | Week 4 | |
| SVR | SSR | SVR | SSR | SVR | SSR | SVR | SSR |
| 14 | 0.21 | 11 | 0.69 | 11 | 0.66 | 11 | 0.65 |

What is claimed is:

1. A method for the suspension of colloidal or non-colloidal abrasive particles in an aqueous or semi aqueous carrier medium which comprises producing a stable precipitate or suspending particles so as to establish a particle to particle interference to settling of the abrasive particles in an aqueous carrier containing about 0.1 to 70% by weight of the abrasive inorganic and/or ceramic particles with about 0.1 to 20% by weight of suspending particles which differ from said abrasive particles and are selected from the group consisting of metal oxides, metal hydroxides, and metal oxide hydrates that form a suspended precipitate, gel, sol, solid emulsion or gelatinous suspension in said carrier medium at a pH of about 4 to 12.

2. The method of claim 1 wherein said aqueous carrier medium comprises 5 to 100% by weight water.

3. The method of claim 1 wherein said suspending particles as formed in the aqueous medium have a density similar to or less than the aqueous carrier medium.

4. The method of claim 1 wherein said aqueous carrier medium contains at least one inert polar solvent.

5. The method of claim 4 wherein said polar solvent is selected from the group consisting of dialkylene glycol, alkylene glycol, glycol ether, polyalkylene glycol, alkyl lactone, N-methylpyrrolidone, alkylene carbonates, acetonitrile, and dimethyl acetamide.

6. The method of claim 1 wherein said suspending particles, sols, gels, gelatinous precipitates or solid emulsion suspensions are metal or transition metal hydroxides formed in situ.

7. The method of claim 6 wherein said suspending particles are selected from the group consisting of aluminum hydroxide, aluminum oxy hydroxide, zinc hydroxide, ferric hydroxide, manganese hydroxide, and magnesium hydroxide, which are formed in situ by treating the corresponding metal sulfate or metal salt with a Bronstead base.

8. The method of claim 1 wherein said abrasive particles are selected from the group consisting of diamond, silicon carbide, silicon, zirconium oxide, silica, cerium oxide, boron carbide, aluminum oxide, silicon nitride, and tungsten carbide.

9. The method of claim 1 including a corrosion inhibitor.

10. An aqueous or semi aqueous abrasive slurry composition for use in wafer or ceramics lapping, wire saw cutting, chemical, mechanical polishing applications, chemical, mechanical planarization, and metal lapping, grinding and finishing applications which comprise:

A. About 0.1 to 70% by weight of abrasive inorganic and/or ceramic particles;

B. About 0.1 to 20% by weight of said suspending particles which differ from said abrasive particles and are selected from the group consisting of metal oxides, metal hydroxides, and metal oxide hydrates that are formed in situ with the carrier medium and form suspended precipitates, gels, sols, colloidal or non-colloidal suspensions in the carrier medium at a pH of about 4 to 12, C. About 5 to 100% by weight water, and D. The remainder being an inert polar solvent.

11. The aqueous abrasive slurry composition of claim 10 wherein said suspending particles have a density similar to or less than the carrier.

12. The aqueous slurry composition of claim 10 including an inert polar solvent.

13. The aqueous slurry composition of claim 12 wherein said polar solvent is selected from the group consisting of dialkylene glycol, alkylene glycol, polyalkylene glycol, glycol ether, alkyl lactone, N-methylpyrrolidone, dimethyl acetamide, alkylene carbonates, acetonitrile, and alkyl amides.

14. The aqueous slurry composition of claim 10 wherein said suspending particles are selected from the group consisting of aluminum hydroxides, aluminum oxyhydroxides, manganese hydroxide, magnesium hydroxide, zinc hydroxide, ferric hydroxide formed in situ by treating the corresponding metal sulfate or metal salt with a Bronstead base to a pH level of from about 4 to 12.

15. The aqueous slurry composition of claim 10 wherein said abrasive particles are selected from the group consisting of diamond, silicon carbide, silicon, zirconium oxide, boron carbide, silica, cerium oxide, aluminum oxide, silicon nitride, and tungsten carbide.

16. The aqueous slurry composition of claim 10 wherein said abrasive particles are about 0.5 to 30 μm in average size.

17. The aqueous slurry composition of claim 10 wherein said abrasive particle size is about 3 to 200 μm.

18. The aqueous slurry composition of claim 10 wherein said abrasive particle size is about 0.1 to 10 μm.

19. The aqueous slurry composition of claim 10 wherein said abrasive particle size is about 50 nm to 1000 nm.

20. The aqueous slurry composition of claim 10 including a corrosion inhibitor.

* * * * *